US006375536B1

(12) United States Patent
Yang

(10) Patent No.: US 6,375,536 B1
(45) Date of Patent: Apr. 23, 2002

(54) ELECTRIC SWAYABLE TOY

(75) Inventor: Shin-Ya Yang, Hsin Tien (TW)

(73) Assignee: Ya Yung Enterprise Co., Ltd., Taipei Hsien (TW)

( * ) Notice: Subject to any disclaimer, the term of this patent is extended or adjusted under 35 U.S.C. 154(b) by 0 days.

(21) Appl. No.: 09/705,127

(22) Filed: Nov. 1, 2000

(51) Int. Cl.[7] ..... A63H 11/00

(52) U.S. Cl. ..... 446/353; 446/330; 40/411; 40/415; 40/418

(58) Field of Search ..... 446/330, 352, 446/353, 354, 358, 376; 40/411, 415, 418

(56) References Cited

U.S. PATENT DOCUMENTS 5,176,560 A * 1/1993 Wetherell
5,911,617 A * 6/1999 Chou
6,071,170 A * 6/2000 How ..... 446/330
6,200,191 B1 * 3/2001 Chou ..... 446/353
6,244,925 B1 * 6/2001 Chou ..... 446/354

* cited by examiner

*Primary Examiner*—Jacob K. Ackun
*Assistant Examiner*—Bena B. Miller
(74) *Attorney, Agent, or Firm*—Pro-Techtor International Services

(57) ABSTRACT

An electric swayable toy includes a body, a shoulder swayably and pivotally on an upper portion of the body, a pair of legs swayably and pivotally mounted on a lower portion of the body, a pair of arms swayably mounted on the shoulder, a head swayably mounted on the shoulder, a pair of shoes swayably supporting the pair of legs in an inclined manner, and a base supporting and securing the pair of shoes. By such an arrangement, the body includes a main swayable mechanism mounted therein, the shoulder includes an arm swayable mechanism, the main swayable mechanism includes a motor which is rotated continuously in a signal direction and the speed of the motor is reduced by a speed reduction mechanism to actuate an eccentric wheel and a cam mechanism so that the legs, the body, and the shoulder are swayable while the arms and the head are swayable by actuation of the arm swayable mechanism.

2 Claims, 7 Drawing Sheets

ELECTRIC SWAYABLE TOY

BACKGROUND OF THE INVENTION

1. Field of the Invention

The present invention relates to an electric swayable toy.

2. Description of the Related Art

Taiwan Utility Model Publication No. 334837 entitled "Swayable device of an toy", discloses a device comprising a motor which actuates sector gears mounted on the joints of a pair of legs of a toy through a gear transmission device. At the same time, an auxiliary tooth track mounted on the other side of the joint of the leg meshes with a tooth track mounted on the back plate of the toy so that the pivot axles of the joints of the legs and the pivot axles of the shoulder construct a four-linkage action so that the two legs and the upper body are oscillated along the different directions.

However, the oscillation of the legs and the body is performed by the gears co-operating with the tooth tracks so that the movement is not smooth. In addition, the shoulder can only be moved in a vertical manner while the head and the two arms are stationary, thereby decreasing the active amusement of the toy.

SUMMARY OF THE INVENTION

In accordance with one aspect of the present invention, there is provided an electric swayable toy comprising:

a body;

a shoulder swayably and pivotally on an upper portion of the body;

a pair of legs swayably and pivotally mounted on a lower portion of the body;

a pair of arms swayably mounted on the shoulder;

a head swayably mounted on the shoulder;

a pair of shoes swayably supporting the pair of legs in an inclined manner; and a base supporting and securing the pair of shoes;

wherein, the body includes a main swayable mechanism mounted therein, the shoulder includes an arm swayable mechanism, the main swayable mechanism includes a motor which is rotated continuously in a signal direction and the speed of the motor is reduced by a speed reduction mechanism to actuate an eccentric wheel and a cam mechanism so that the legs, the body, and the shoulder are swayable while the arms and the head are swayable by actuation of the arm swayable mechanism.

The main swayable mechanism includes a motor secured on a rocking board which is swayably mounted in an inside of the body and has an upper end and a lower end respectively pivoted on the shoulder and a lower portion of the body, a speed reduction mechanism including belt wheels and gear sets for reducing the output rotational speed of the motor and increasing the torque of the motor, an eccentric wheel actuated by the speed reduction mechanism, and a cam defining a cam slot for receiving the eccentric wheel and actuated by the eccentric wheel to move reciprocally.

The arm swayable mechanism includes a pair of symmetrical axle members each pivotally mounted in the shoulder, and a pair of symmetrical push/pull bars each including an upright bar portion secured on a follower element of the axle member, and a horizontal bar portion slidably mounted on a pin which is mounted on the rocking board.

The axle members of the arm swayable mechanism are connected with a pair of cams each of which has a top rested on a wing of a support member of the head, whereby, when the pair of cams are rotated along different directions, the wing is driven to move the head so that the head is pivoted about a pivot axle of a pivot portion.

The distance between the lower portion of the body and a pivot axle of an upper portion of the legs is greater than that between the upper portion of the body and a pivot axle of a lower portion of the shoulder.

An upper arm portion of each of the arms and the axle member of the arm swayable mechanism have a connection portion having a joint which is constructed to be rotatable along a vertical plan and/or a horizontal plane freely, and/or a lower arm portion and an upper arm portion of each of the arms have a connection portion having a joint which is constructed to be rotatable along a vertical plan and/or a horizontal plane freely.

The rocking board has a lower portion having two symmetrical pins each slidably mounted in a guide slot of an arcuate cam formed on an upper portion of each of the arms.

Further benefits and advantages of the present invention will become apparent after a careful reading of the detailed description with appropriate reference to the accompanying drawings.

DETAILED DESCRIPTION OF THE INVENTION

Figure 1:
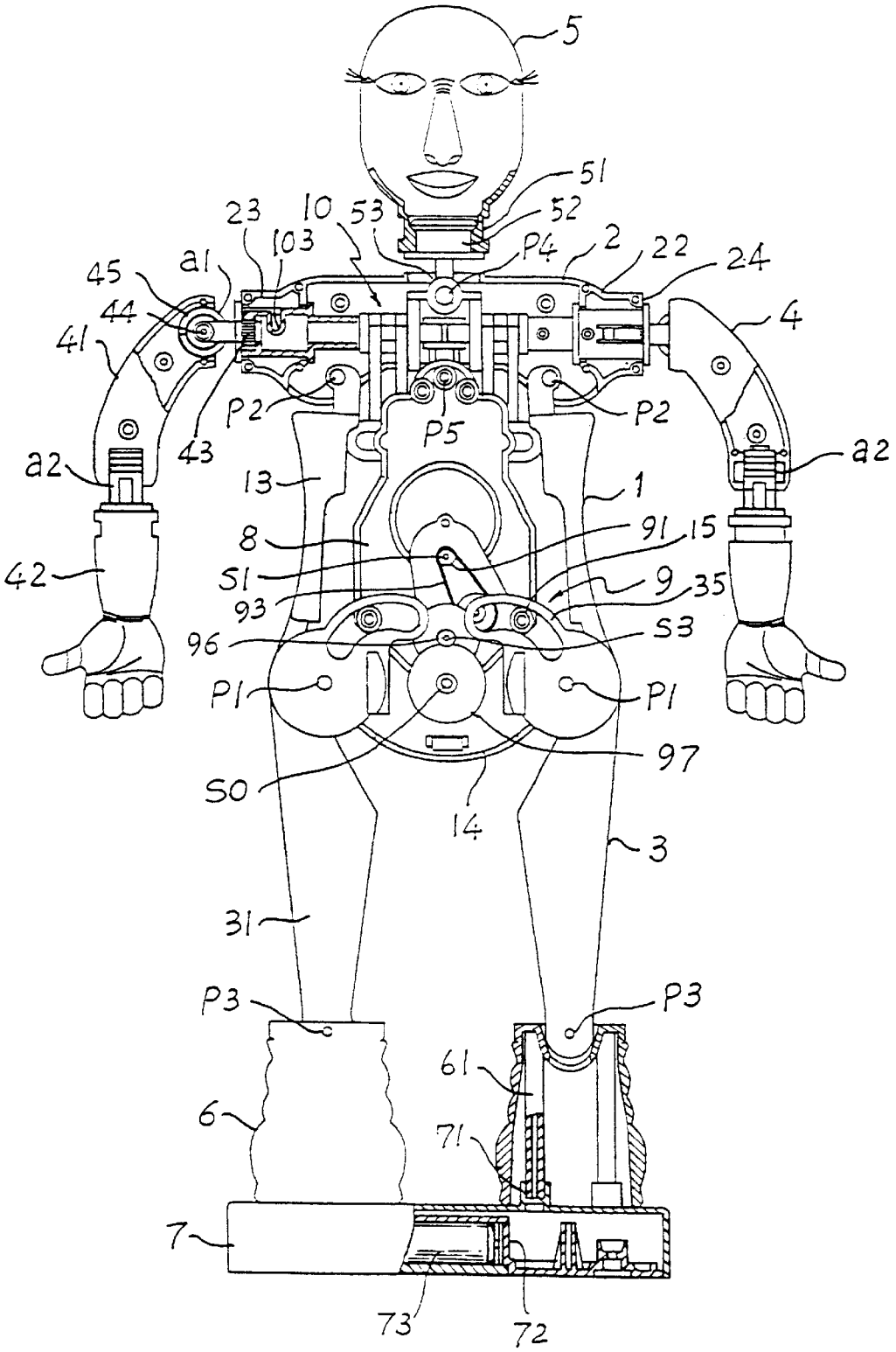
FIG. 1 is a front plan view of an electric swayable toy in accordance with the present invention.
Figure 2:
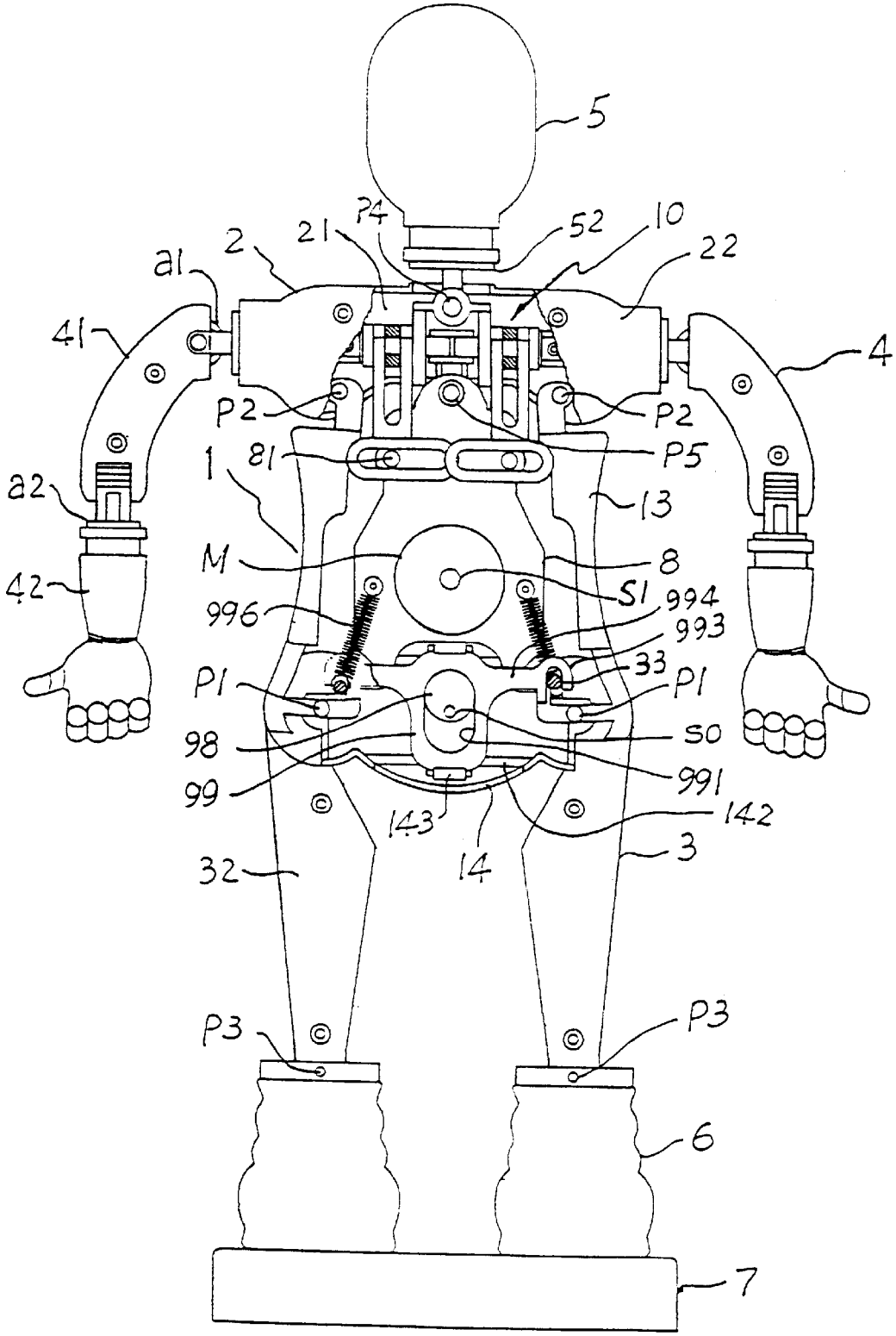
FIG. 2 is a rear plan view of the electric swayable toy as shown in FIG. 1.
Figure 3:
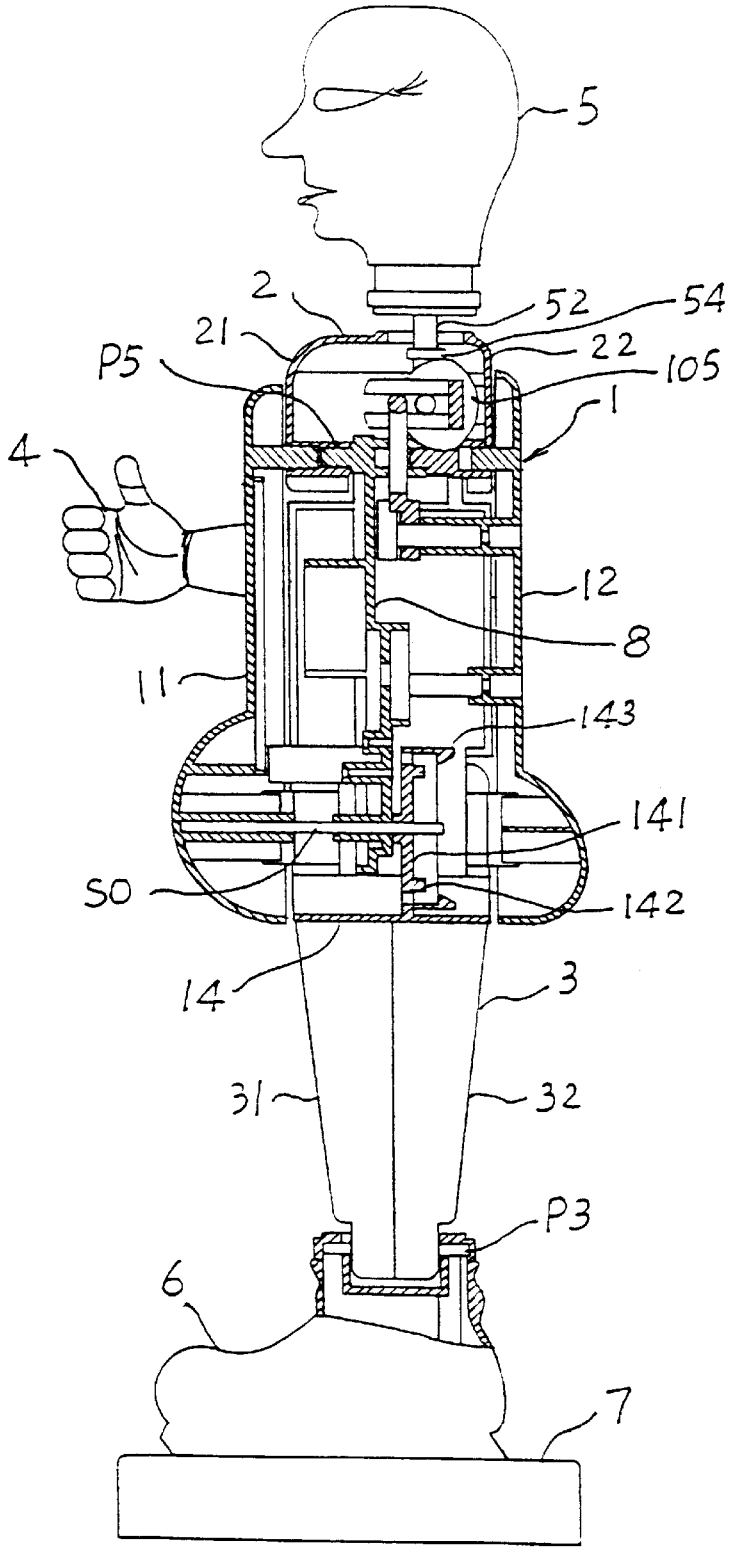
FIG. 3 is a side plan cross-sectional view of the electric swayable toy as shown in FIG. 1.

Referring to the drawings and initially to FIGS. 1–3, an electric swayable toy in accordance with the present invention comprises a body 1, a shoulder 2 swayably and pivotally on an upper portion of the body 1, a pair of legs 3 swayably and pivotally mounted on a lower portion of the body 1, a pair of arms 4 swayably mounted on the shoulder 2, a head 5 swayably mounted on the shoulder 2, a pair of shoes 6 swayably supporting the pair of legs 3 in an inclined manner, and a base 7 supporting and securing the pair of shoes 6.

A rocking board 8 is swayably mounted in the inside of the body 1 and has an upper end and a lower end respectively pivoted on the shoulder 2 and a lower portion of the body 1.

The body 5 includes a main swayable mechanism 9 mounted on the rocking board 8. The shoulder 2 includes an arm swayable mechanism 10 mounted therein. The main swayable mechanism 9 includes a motor M which is rotated continuously in a signal direction, and the speed of the motor M is reduced by a speed reduction mechanism to actuate an eccentric wheel 98 and a cam mechanism so that the legs 3, the body 1, and the shoulder 2 are swayable while the arms 4 and the head 5 are swayable by actuation of the arm swayable mechanism 10.

The body 1 includes a front cover plate 11 corresponding to the chest and abdomen of the toy, a rear cover plate 12 corresponding to the back of the toy, two side plates 13 corresponding to the waist of the toy, and a bottom plate 14 corresponding to the hip of the toy. The body 1 is pivoted on the legs 3 by pivot axles P1.

The shoulder 2 includes a front shoulder plate 21, and a rear shoulder plate 22, and is pivoted on the body 1 by a pivot axle P2.

Each of the legs 3 includes a front half leg 31, and a rear half leg 32. Each of the legs 3 has an upper portion connected to the body by the pivot axle P1, and a lower portion pivotally mounted on one of the shoes 6 by a pivot axle P3.

Each of the arms 4 includes an upper arm portion 41 and a lower arm portion 42. The upper arm portion 41 of each of the arms 4 and the axle member 10*a* of the arm swayable mechanism 10 have a connection portion having a joint al which is constructed to be rotatable along a vertical plan and/or a horizontal plane freely, and/or the lower arm portion 42 and an upper arm portion 41 of each of the arms 4 have a connection portion having a joint a2 which is constructed to be rotatable along a vertical plan and/or a horizontal plane freely.

The head 5 includes a neck 51 inserted with a support member 52 which has a lower portion provided with an eye ring 53 which is pivotally mounted on the shoulder 2 by a pivot axle P4.

Each of the shoes 6 is inserted into a socket 71 of the base 7 through a pin 61. The base 7 has a bottom provided with a battery chamber 72 for containing a battery 73. A switch (not shown) is provided for switching the power supply. The base 7 can be provided with a power receptacle (not shown) for use with an adapter (not shown).

The rocking board 8 is swayably mounted in the inside of the body 1 and has an upper end pivoted on the shoulder 2, and a lower end pivoted on the bottom plate 14 of the body 1 by a bottom axle S0.

Figure 4:
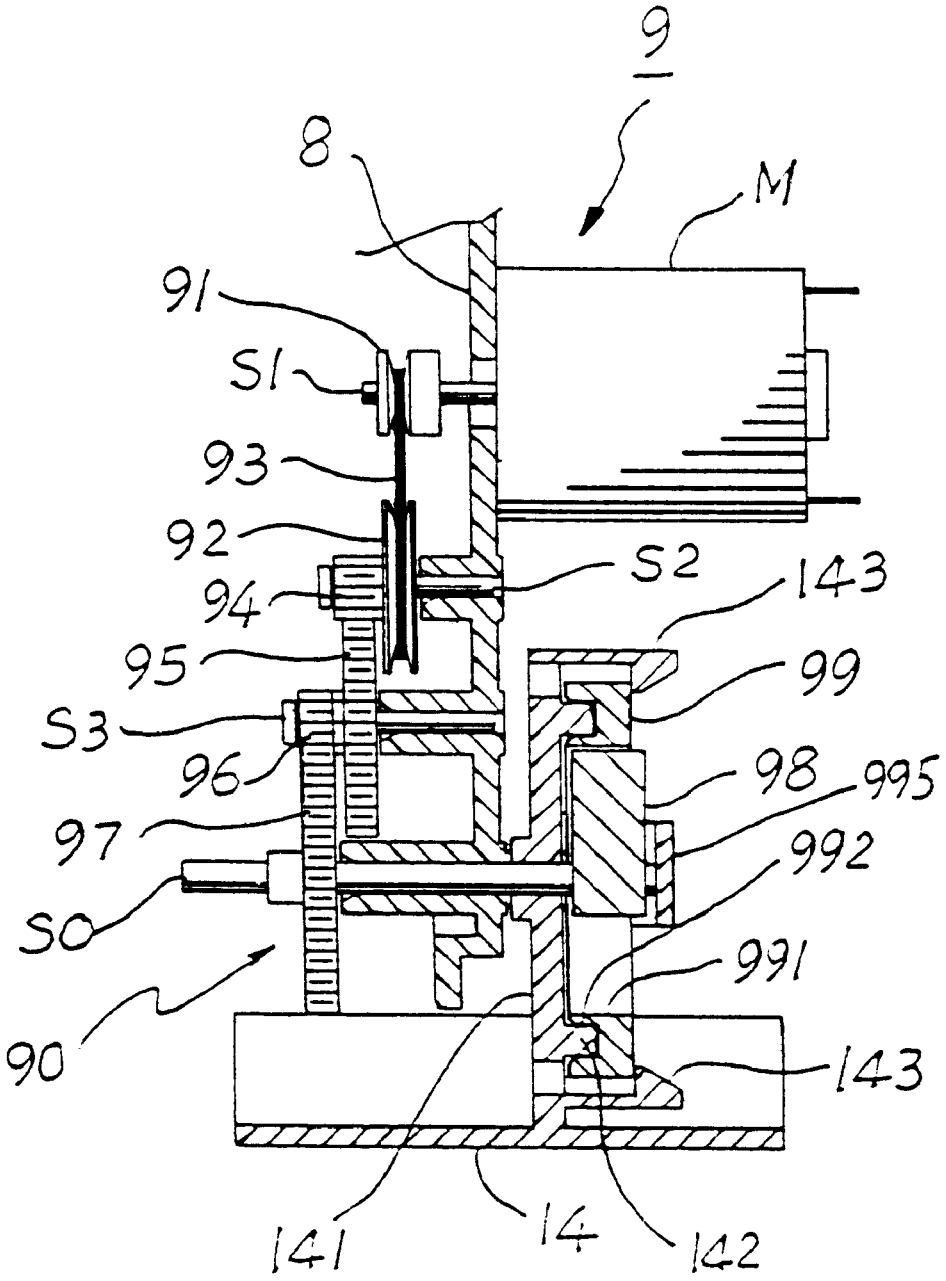
FIG. 4 is a side plan cross-sectional view of a main swayable mechanism of the electric swayable toy as shown in FIG. 1.

The main swayable mechanism 9 as shown in FIG. 4 includes a motor M mounted on one side of the rocking board 8 and having an output shaft S1 protruding outward from the rocking board 8. A small belt wheel 91 is secured on the output shaft S1 of the motor M. A large belt wheel 92 is rotatably mounted on the rocking board 8 by a shaft S2, and is located under the small belt wheel 91. A belt 93 is mounted between the large belt wheel 91 and the small belt wheel 92 for transmitting the output power of the motor M. A first pinion 94 is mounted on the shaft S2 to rotate with the large belt wheel 92. A first large gear 95 is rotatably mounted on a shaft S3, and meshes with the first pinion 94 to rotate therewith. A second pinion 96 is integrally formed with the first large gear 95 to rotate therewith. A second large gear 97 is secured on a first end of the bottom shaft S0 of the rocking board 8, and meshes with the second pinion 96 to rotate therewith. An eccentric wheel 98 is secured on a second end of the bottom shaft S0 to rotate with the second large gear 97, wherein the second end of the bottom shaft S0 extends through the rocking board 8 and an upright plate 141 of the bottom plate 14. A cam 99 is mounted on the upright plate 141 of the back of the rocking board 8, and defines an oblong cam slot 991 for receiving the eccentric shaft 98.

Horizontal guide track devices 992 and 142 are mounted between the cam 99 and the upright plate 141, and the cam 99 has two sides each provided with an extension 994 having a hook 993 hooked on a pin 33 of the upper portion of the leg 3. An elastic detent 143 is mounted on the upright plate 141 of the bottom plate 14 for retaining the cam 99 to prevent from detachment of the cam 99. A catch plate 995 is mounted on the cam 99 for preventing the eccentric wheel 98 from being detached from the bottom shaft S0. The belt wheels 91 and 92, and the gear sets 94 and 95 construct the speed reduction gear set 90. Two tension springs 996 are mounted on the back of the rocking board 8 for facilitating operation of the swayable mechanism.

When the motor M is rotated, the eccentric wheel 98 is rotated with the large gear 97 whose speed is reduced by the speed reduction gear set 90. The cam 99 is moved by the eccentric wheel 98 co-operating with the cam slot 991 so that the two extensions 994 will push each of the legs 3 to pivot about the pivot axle P3 by means of the hook 993 co-operating with the pin 33.

Figure 7:
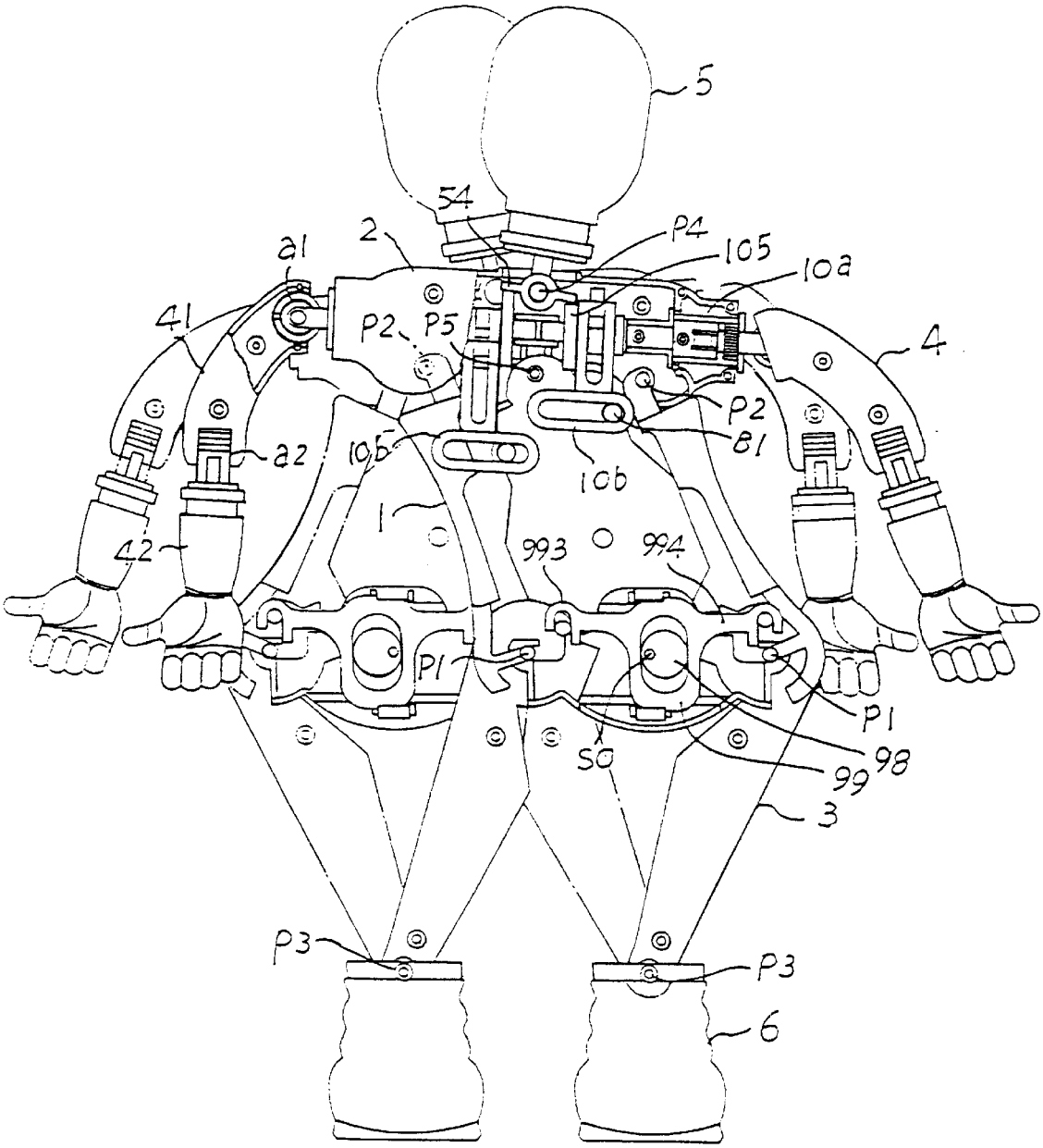
FIG. 7 is an operational view of the electric swayable toy as shown in FIG. 2.

When each of the legs 3 oscillates, the bottom plate 14 pivoted on the legs 3 by the pivot axle P1 is moved with the legs 3. The rocking board 8 pivoted on the bottom plate 14 by the bottom shaft S0 will oscillate due to the resistance of the springs 996 as shown in FIG. 7.

Figure 5:
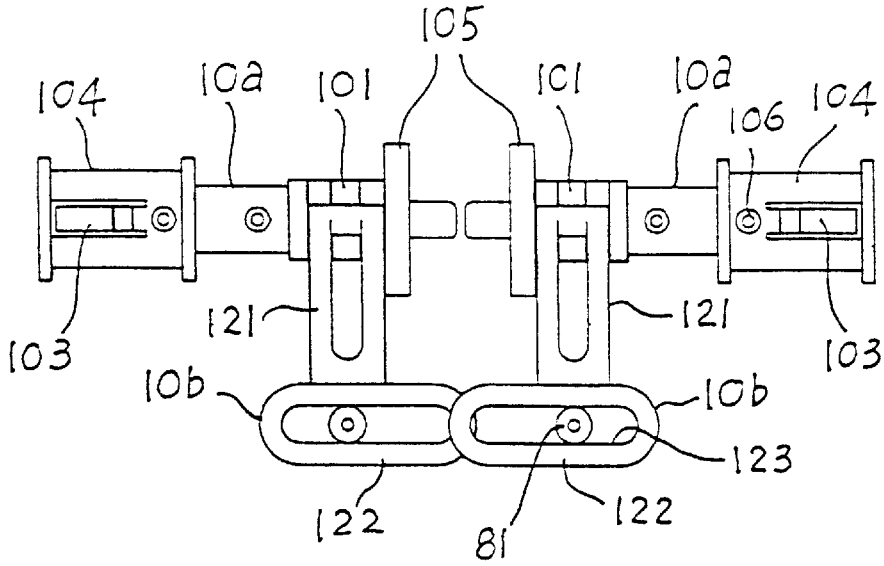
FIG. 5 is a front plan schematic view of an arm swayable mechanism of the electric swayable toy as shown in FIG. 1.
Figure 6:
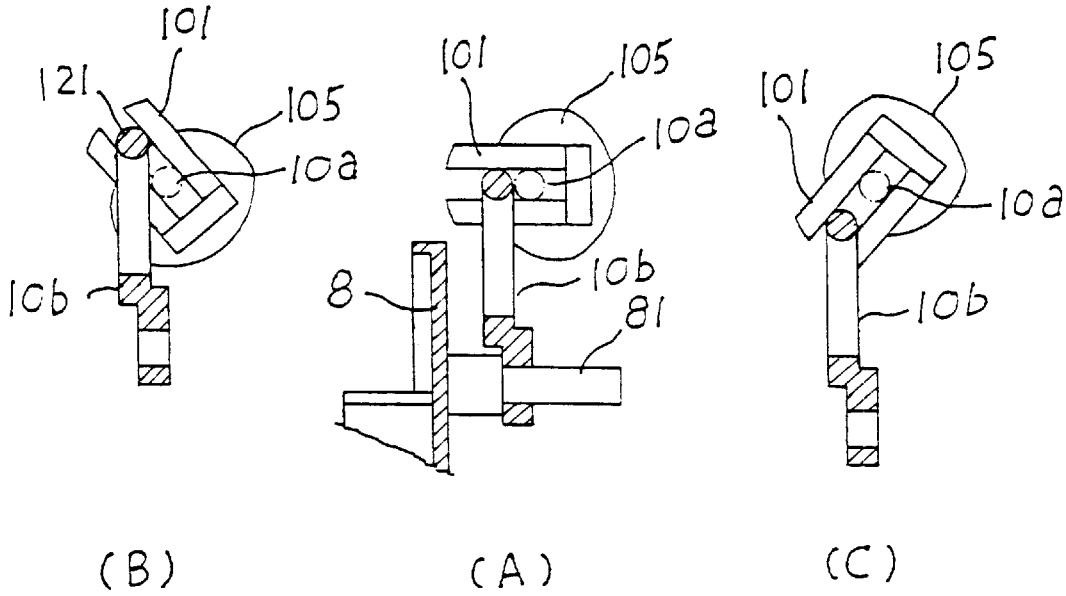
FIG. 6A is a side plan view of the arm swayable mechanism of the electric swayable toy as shown in FIG. 5.
FIG. 6B is an operational view of the arm swayable mechanism of the electric swayable toy as shown in FIG. 6A.
FIG. 6C is an operational view of the arm swayable mechanism of the electric swayable toy as shown in FIG. 6A.

As shown in FIGS. 1, 5 and 6, the arm swayable mechanism 10 includes a pair of symmetrical axle members 10*a* each pivotally mounted in the bearings 23 and 24 of the shoulder 2, and a pair of symmetrical push/pull bars 10*b* each including an upright bar portion 121 secured on a U-shaped forked portion 101 of the axle member 10*a,* and a horizontal bar portion 122 slidably mounted on a pin 81 of the rocking board 8 by a transverse slot 123.

The axle member 10*a* has an inner end provided with an axle end 102, and an outer end provided with a hollow axle end 104 having an elastic pawl 103. A cam 105 is located adjacent to the forked portion 101. The axle member 10*a* is made of two pieces which are integrally coupled by screws 106.

When the rocking board 8 is rocked with the body 1 in an inclined manner, the heights of the pins 81 are made different from each other. As shown in FIG. 7, the higher pin 81 pushes the mating push/pull bar 10*b* upward, and the lower pin 81 pushes the mating push/pull bar 10*b* downward. The two axle members 10*a* are pushed by the two push/pull bars 10*b* through the forked portion 102 to rotate around a circle along the clockwise direction and the counterclockwise direction respectively as shown in FIGS. 6B and 6C. in such a manner, the legs 4 connected to the hollow axle portion 104 of the axle member 10*a* are oscillated with the rocking board 8.

When the axle members 10*a* are rotated by pushing the push/pull bar 10*b,* the cams 105 are rotated simultaneously. Each of the cams 105 has a top rested on a wing 54 of the eye ring 53 which is supported on a support member 52 of the head 5. In such a manner, when the pair of cams 105 are rotated along different directions, the wing 54 is driven to move the head 5 so that the head 5 is pivoted with the arms 4 about a pivot axle P4.

Basically, the distance between the pivot axle P1 and the pivot axle P3 is greater than that between the pivot axle P1 and the pivot axle P2. In addition, the distance between the two pivot axles P1 is equal to that between the two pivot axles P3, and is greater than that between the two pivot axles P2. In such a manner, P1, P3, P3 and P1 construct a parallelogram, and P1, P2, P2 and P1 construct a trapezoid so that when the legs 3 and the body 1 sway, the shoulder 2 is caused to move upward and downward as shown in phantom lines in FIG. 7.

The joint a1 includes a ratchet wheel 43 rotatably mounted in the hollow axle portion 104 and locked by the elastic pawl 103, an annular element 45 mounted on the other end of the ratchet wheel shaft 43*a* to rotate relative to the upper arm portion 41 by a shaft 44 and having a locking pawl (not shown), and a semi-circular ratchet wheel 46 formed in the upper arm portion 41 and locked by the locking pawl. The joint a2 includes a plug element 47 secured in the lower arm portion 42, and a semi-circular ratchet wheel 48 rotatably inserted into the lower arm portion 42 by a shaft 44a and locked by a locking pawl 49 which is mounted in the lower arm portion 42.

The rocking board 8 has a lower portion having two symmetrical pins 15 each slidably mounted in a guide slot of an arcuate cam 35 formed on an upper portion of each of the arms 3.

Figure 8:
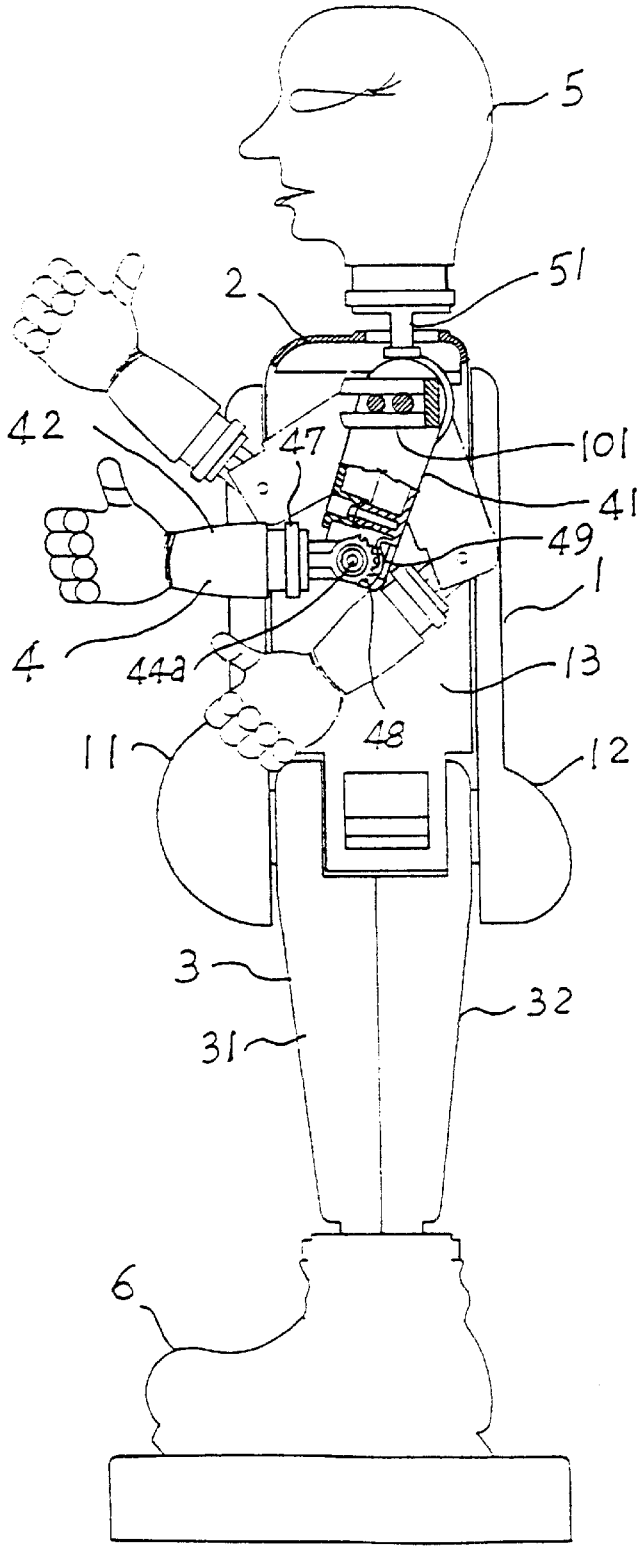
FIG. 8 is an operational view of the electric swayable toy as shown in FIG. 3.

In operation, referring to FIGS. 7 and 8, when the motor M is rotated, the torque of the motor M is transmitted through the belt wheel 91, the belt 93, the belt wheel 92, the gears 94, 95, 96 and 97, and the shaft S0 to the eccentric wheel 98 which is eccentrically rotated in the cam slot 991 of the cam 99 so as to push the cam 99 to move in the guide track devices 992 and 142 reciprocally. The legs 3 are pushed and pulled by the two extensions 994 of the cam 99 to oscillate about the pivot axle 3 in an inclined manner. The two side plates 13 are pivoted about the pivot axle P1 to oscillate in the other direction. The bottom plate 14 pivoted on the pivot axle P1, the rocking board 8 pivoted on the bottom shaft S0, the front cover plate 11 mounted on the front side of the rocking board 8, and the rear cover plate 12 mounted on the rear side of the rocking board 8 are oscillated in the same direction while the shoulder 2 pivoted on the two side plates 13 and the rocking board 8 by the pivot axles P2 and P5 is also oscillated therewith. At the same time, the two arms 4 are also oscillated by actuation of the arm swayable mechanism 10 while the head 5 is moved by the cam 105 of the arm swayable mechanism 10 to pivot about the pivot axle P4 along a direction different from that of the shoulder 2.

In such a manner, when the legs and the waist of the toy are oscillated, the shoulder, the arms and the head can also be oscillated at the same time, thereby increasing the active amusement of the toy.

It should be clear to those skilled in the art that further embodiments may be made without departing from the scope of the present invention.

What is claimed is:

1. An electric swayable toy comprising:

a body, a shoulder swayably and pivotally mounted on an upper portion of said body, a pair of legs swayably and pivotally mounted on a lower portion of said body, a pair of arms swayably mounted on said shoulder, a head swayably mounted on said shoulder, a pair of shoes swayably supporting said pair of legs, a base supporting and securing said pair of shoes, a main swaying mechanism mounted in said body, and an arm swaying mechanism mounted in said shoulder; wherein said main swaying mechanism comprises a motor secured on a rocking board which is swayably mounted in an interior of said body and has an upper end and a lower end pivoted on said shoulder and a lower portion of said body respectively, said motor comprises a speed reduction mechanism to reduce a speed of said motor, said speed reduction mechanism comprising belt wheels and gear sets to reduce an output rotational speed of said motor and to increase torque generated by said motor, said main swaying mechanism further comprising an eccentric wheel actuated by said speed reduction mechanism, and a cam with a cam slot therein to receive said eccentric wheel, said cam being actuated by said eccentric wheel to move reciprocally so that said legs, said body, and said shoulder sway, and wherein said arm swaying mechanism comprises a pair of symmetrical axle members each pivotally mounted in said shoulder, said axle members being in communication with said rocking board via a pair of symmetrical bars each including a vertical bar portion secured to said axle members, and a horizontal bar portion slidably mounted on a pin which is mounted on said rocking board, said axle members being connected to a pair of cams, each said cam having a top that rests on a wing of a support member of said head, such that when said pair of cams are rotated in different directions, said wing is driven to move said head so that said head is pivoted about a pivot axle of a pivot portion.

2. An electric swayable toy comprising:

a body, a shoulder swayably and pivotally mounted on an upper portion of said body, a pair of legs swayably and pivotally mounted on a lower portion of said body, a pair of arms swayably mounted on said shoulder, a head swayably mounted on said shoulder, a pair of shoes swayably supporting said pair of legs, a base supporting and securing said pair of shoes, a main swaying mechanism mounted in said body, and an arm swaying mechanism mounted in said shoulder; wherein said main swaying mechanism comprises a motor secured on a rocking board which is swayably mounted in an interior of said body and has an upper end and a lower end pivoted on said shoulder and a lower portion of said body respectively, said motor comprises a speed reduction mechanism to reduce a speed of said motor, said speed reduction mechanism comprising belt wheels and gear sets to reduce an output rotational speed of said motor and to increase torque generated by said motor, said main swaying mechanism further comprising an eccentric wheel actuated by said speed reduction mechanism, and a cam with a cam slot therein to receive said eccentric wheel, said cam being actuated by said eccentric wheel to move reciprocally so that said legs, said body, and said shoulder sway, and wherein said rocking board has a lower portion having two symmetrical pins each slidably mounted in a guide slot of an arcuate cam formed on an upper portion of each of said legs.

* * * * *